US012134506B1

(12) United States Patent
Price et al.

(10) Patent No.: US 12,134,506 B1
(45) Date of Patent: Nov. 5, 2024

(54) STACKABLE CORRUGATED WAX BOX

(71) Applicants: Tyler Price, Taylorsville, NC (US); Jason Tomblin, Stony Point, NC (US)

(72) Inventors: Tyler Price, Taylorsville, NC (US); Jason Tomblin, Stony Point, NC (US)

( * ) Notice: Subject to any disclaimer, the term of this patent is extended or adjusted under 35 U.S.C. 154(b) by 158 days.

(21) Appl. No.: 17/962,824

(22) Filed: Oct. 10, 2022

(51) Int. Cl.
*B65D 71/00* (2006.01)
*B65D 19/44* (2006.01)
*B65D 81/18* (2006.01)

(52) U.S. Cl.
CPC ..... *B65D 71/0096* (2013.01); *B65D 19/44* (2013.01); *B65D 81/18* (2013.01); *B65D 2205/00* (2013.01); *B65D 2519/00084* (2013.01)

(58) Field of Classification Search
CPC .... B65D 71/0096; B65D 19/44; B65D 81/18; B65D 71/00; B65D 2205/00
USPC ..... 206/386, 503, 507, 511
See application file for complete search history.

(56) References Cited

U.S. PATENT DOCUMENTS 4,585,381 A 4/1986 Boyse
5,332,114 A * 7/1994 Sano ..... B65D 21/0234 206/508
5,598,757 A 2/1997 Pronk
5,685,233 A 11/1997 DeJean
5,794,542 A * 8/1998 Besaw ..... B65D 19/20 108/56.1
6,170,689 B1 * 1/2001 Flesher ..... B65D 19/18 206/508
7,503,455 B2 * 3/2009 McDade ..... B65D 21/0215 206/509
7,718,924 B2 * 5/2010 Claffy ..... B29C 44/0407 206/499
8,308,411 B2 11/2012 Funk et al.
10,239,658 B1 3/2019 Cribbs
10,301,067 B2 * 5/2019 Tippmann ..... B65D 81/263
10,807,764 B2 10/2020 Tippmann
10,913,571 B2 2/2021 Kuhmann et al.
2004/0173493 A1 * 9/2004 Pope ..... B65D 77/02 206/557
2006/0237341 A1 * 10/2006 McDade ..... B65D 21/0235 206/509
2015/0027917 A1 * 1/2015 Goddard ..... B65D 19/18 206/386

* cited by examiner

*Primary Examiner* — Rafael A Ortiz
(74) *Attorney, Agent, or Firm* — Cramer Patent & Design PLLC; Aaron R. Cramer

(57) ABSTRACT

A stackable corrugated was box is a specialized box to be used to store food products in cold storage. The box is supplied with a built in "slat" or spacer at the bottom of the box. The spacer is generally rectangular shaped and is approximately thirteen by nineteen inches (13×19") and one inch (1") thick. The bottom surface is provided with approximately eight (8) pedestals to produce an "egg-crate" like bottom with open areas all of the way across the bottom. This open area allows for air flow across the entire bottom area of the box, thus allowing for rapid freezing times when compared to conventional boxes that are stacked upon one another.

2 Claims, 5 Drawing Sheets

STACKABLE CORRUGATED WAX BOX

RELATED APPLICATIONS

Not applicable.

FIELD OF THE INVENTION

The presently disclosed subject matter is directed to a box used in the cold storage industry and more specifically to a stackable corrugated wax box.

BACKGROUND OF THE INVENTION

The vast majority of frozen food products are frozen in a flash freezing process. This process ensures that food is not only rapidly frozen thus reducing overall handling and processing time, but also ensures that the food retains its maximum freshness while ensuring that it is safe to consume. The flash freezing process requires the maximum air flow around a product as possible.

A pallet full of food that is contained in cardboard boxes will freeze rapidly around the exterior surfaces, but the inner areas at the center of the pallet will take a long time, if they even freeze at all. To speed this process along, workers must restack boxes on a different pallet with spacers in between each layer of boxes. This spacer has a cross sectional configuration similar to that of an egg-crate thus allowing air to easily move from side to side.

This obviously takes a great deal of time and manpower when dealing with truck load of boxed product. Accordingly, there exists a need for a means by which a food items can be initially fast frozen without the necessity to manually restock each box. The development of the stackable corrugated was box fulfills this need.

SUMMARY OF THE INVENTION

The principles of the present invention provide for a stacking device has a base having an upper surface, a lower surface, an outer surface, and a plurality of edges and a plurality of sidewalls extending perpendicularly upward from the edges of the base to surround a cavity, each of the sidewalls includes an inner surface and an outer surface.

The sidewalls of the base may be coextensive with the outer surface of each of the sidewalls. The sidewalls and the upper surface of the base may define a cavity. The cavity may be configured to hold one or more products being transported in bulk on a pallet. The cavity may be 6.5 in deep. The sidewalls may form a five-sided structure. The outer surface of the base may be a plurality of corner posts, a plurality of edge posts, and a plurality of center posts.

The corner posts, the edge posts, and the center posts may be configured to facilitate flash freezing of the products in the cavity of the stacking device by improving circulation of air about each of a plurality of the stacking devices stacked on the pallet. The corner posts may be disposed at each corner of the base. The corner posts may be oriented to have no portion thereof protruding or extending away from the sidewalls of the base and the outer surface of the sidewalls. The corner posts may be identical in size, shape, and orientation.

The edge posts may be disposed equidistant between the corner posts of the base. The center posts may be disposed along a bisecting center axis of the base along parallel with the perimeter edges of the base and between the corner posts and the edge posts. The center posts may each be oriented at 45° angles relative to the corner posts and the edge posts. The center posts may be identical in size, shape, and orientation. The corner posts, the edge posts, and the center posts are made from a corrugated material to withstand repeated and rough handling and stacking.

The stacking device may be made of a wax corrugated material for one or more perishable food products. The stacking device may be made of a wax corrugated material for one or more non-perishable food products. The stacking device may be 19.0 ins. long. The stacking device may be 13.0 ins. width.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
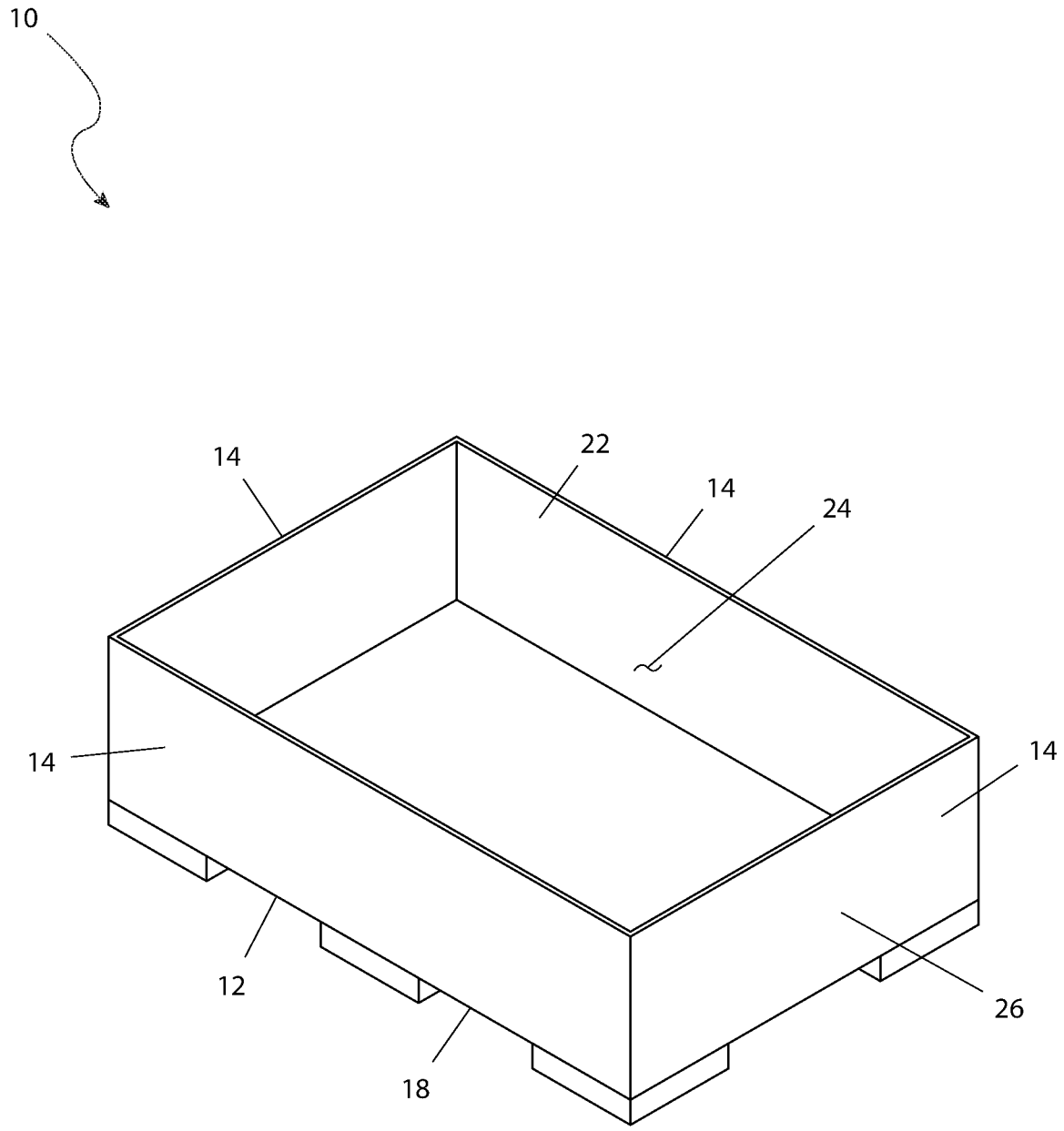
FIG. 1 is a perspective view of a stacking device, according to the preferred embodiment of the present invention.

10 stacking device
12 base
14 sidewall
16 upper surface
18 bottom surface
22 inner surface
24 cavity
26 outer surface
30 corner post
32 edge post
34 center post
40 lid
D overall depth
D1 corner post depth
D2 edge post depth
D3 center post depth
L overall length
L1 corner post first length
L2 corner post second length
L3 edge post first length
L4 edge post second length L5 center post first length
L6 center post second length
P pallet
W overall width

DESCRIPTION OF THE PREFERRED EMBODIMENTS

The best mode for carrying out the invention is presented in terms of its preferred embodiment, herein depicted within FIGS. 1 through 7. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Figure 2:
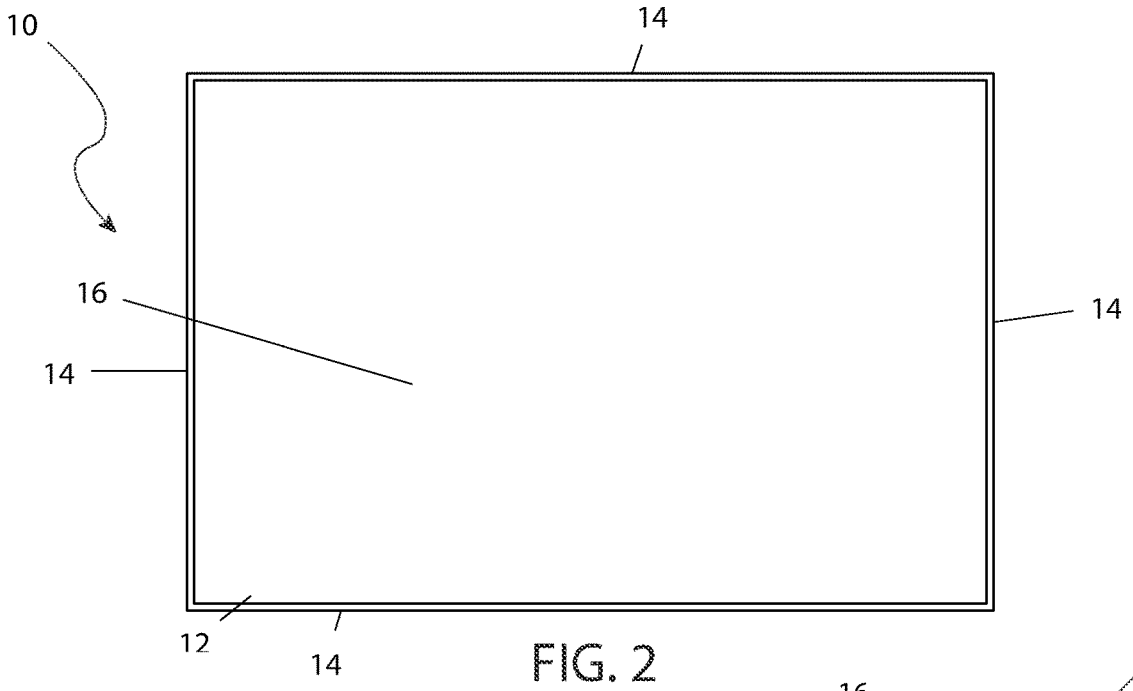
FIG. 2 is a top plan view of the stacking device, according to the preferred embodiment of the present invention.
Figure 7:
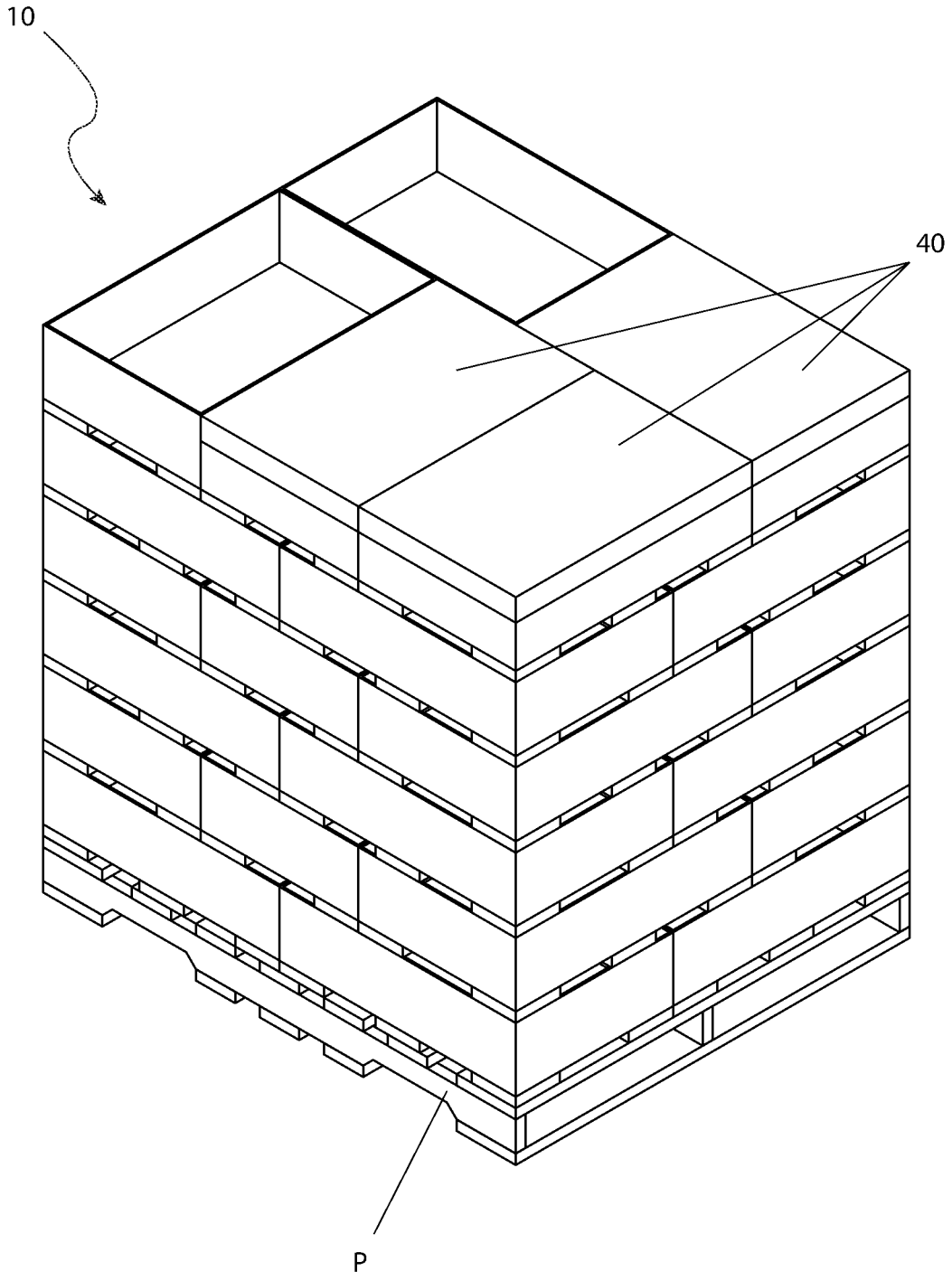
FIG. 7 is a top perspective environmental view of the stacking device in use, according to the preferred embodiment of the present invention.

Referring now to FIGS. 1 and 2, a perspective view and a side view of the stacking device 10, according to the preferred embodiment of the present invention is disclosed. The stacking device 10 provides for a durable and easy stackable storage system for use with pallets P (as seen in FIG. 7).

FIG. 2 shows a stacking device 10 configured as a box having a base 12 that includes an upper surface 16 and a lower surface 18. The stacking device 10 also has a plurality of sidewalls 14, each extending perpendicularly upward from the edges of the base 12 to surround a cavity 24 to form a five-sided structure. The outer sidewalls 14 of the base 12 are preferably coextensive with the outer surfaces 26 of each sidewall 14.

Figure 3:
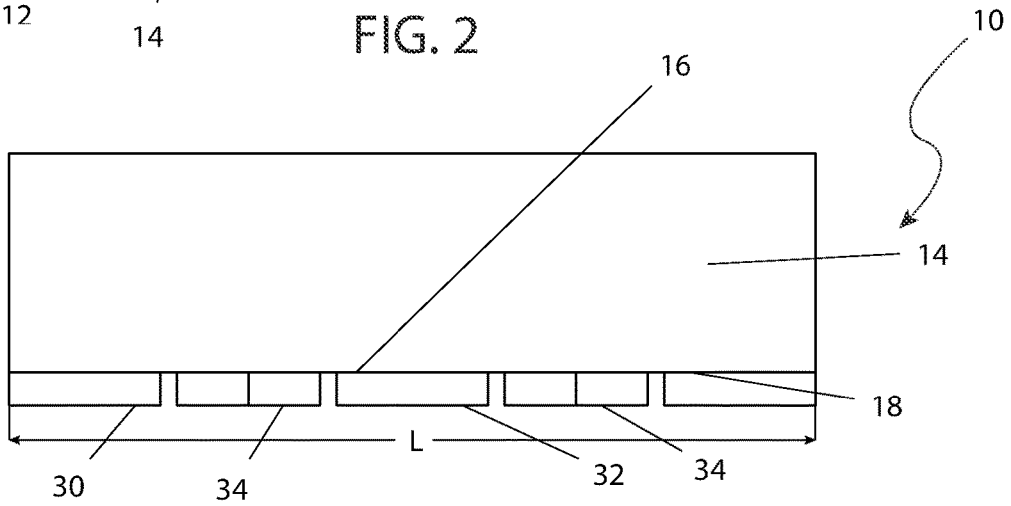
FIG. 3 is a side elevation view of the stacking device, according to the preferred embodiment of the present invention.

As shown in FIG. 3, the stacking service 10 includes an overall length L, an overall width W, and an overall depth D. As shown in FIG. 3 the stacking device includes an overall width W. In some embodiments, the overall length L is approximately nineteen inches (19.0 in.). In some embodiments, the overall width W is approximately thirteen inches (13 in.). However, the exact dimensions are not intended to be a limiting factor of the present invention.

Figure 4:
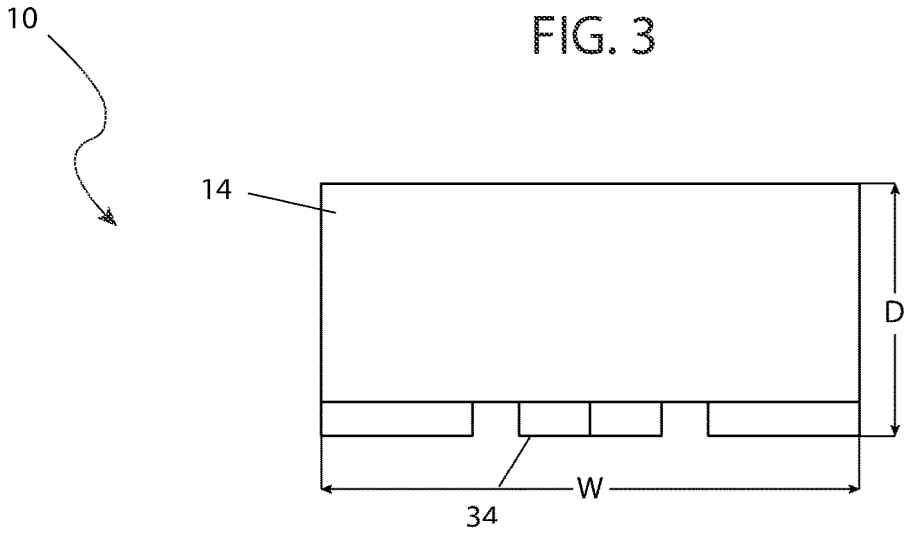
FIG. 4 is an end elevation view of the stacking device, according to the preferred embodiment of the present invention.

FIG. 4 shows the sidewalls extending from the upper surface 16 of the base 12. Each sidewall 14 includes an inner surface 22 and an outer surface 26. The bounds of the sidewalls 14 and upper surface 16 of the base 12 defines a cavity 24, as shown in FIG. 1. The cavity 24 is configured to hold products, for example, frozen food or other products typically being transported in bulk on pallet P. In some embodiments, the overall depth D is approximately six and one-half inches (6.5 in.).

Figure 5:
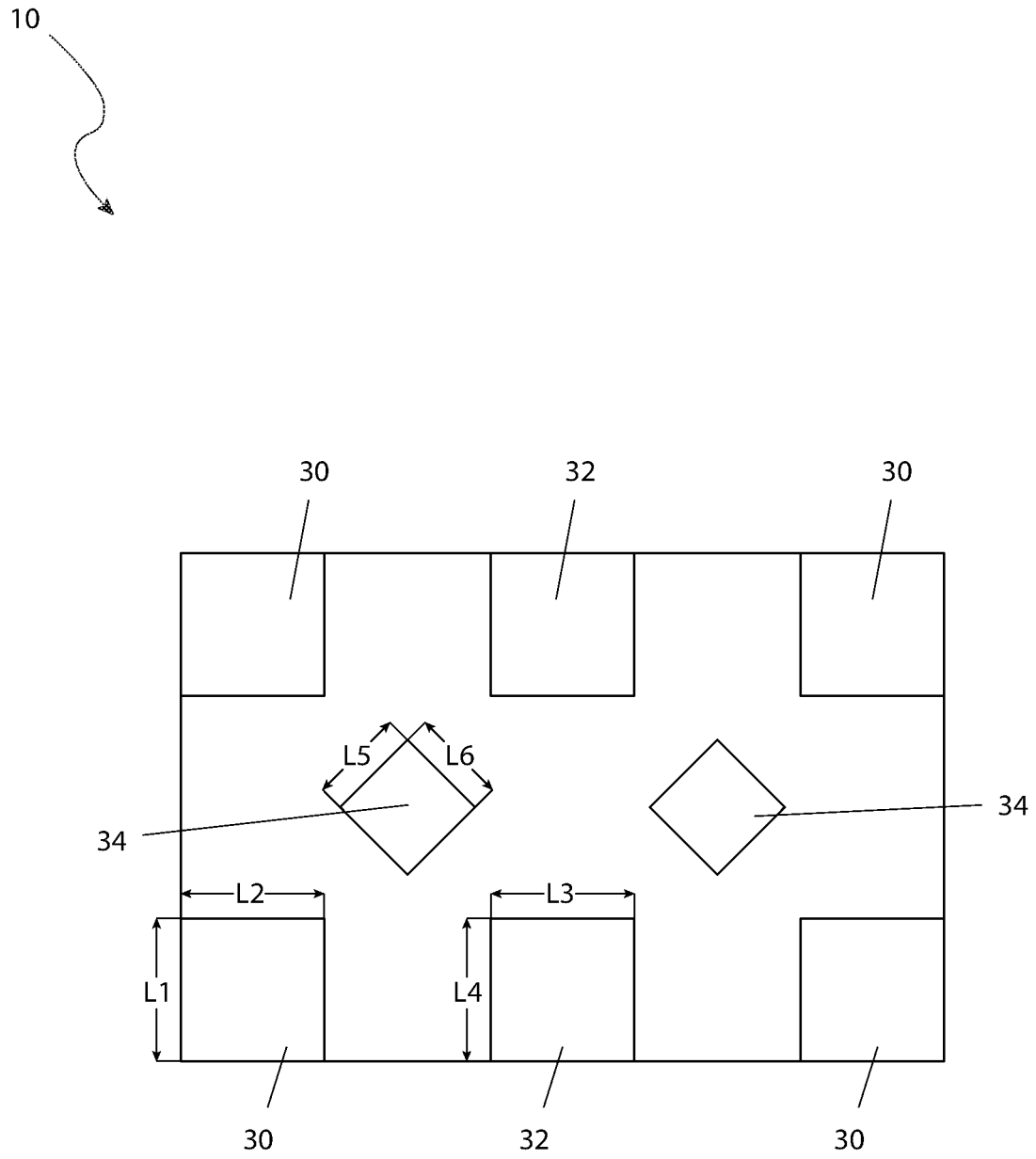
FIG. 5 is a bottom plan view of the stacking device, according to the preferred embodiment of the present invention.

As shown in FIG. 5, attached to or integrally formed with the outer surface 18 of the base 12 is a plurality of corner posts 30, a plurality of edge posts 32, and a plurality of center posts 34 configured to facilitate the stacking of a stacking device 10 onto at least one (1) subjacent stacking device 10 of similar or identical configurations and materials of construction. In some embodiments, the sizes and orientation of the corner posts 30, edge posts 32, and center posts 34 are configured to facilitate flash freezing of the products in the cavity 24 of the stacking device 10 by improving circulation of the air about each stacking device 10 stacked on a pallet P.

Figure 6:
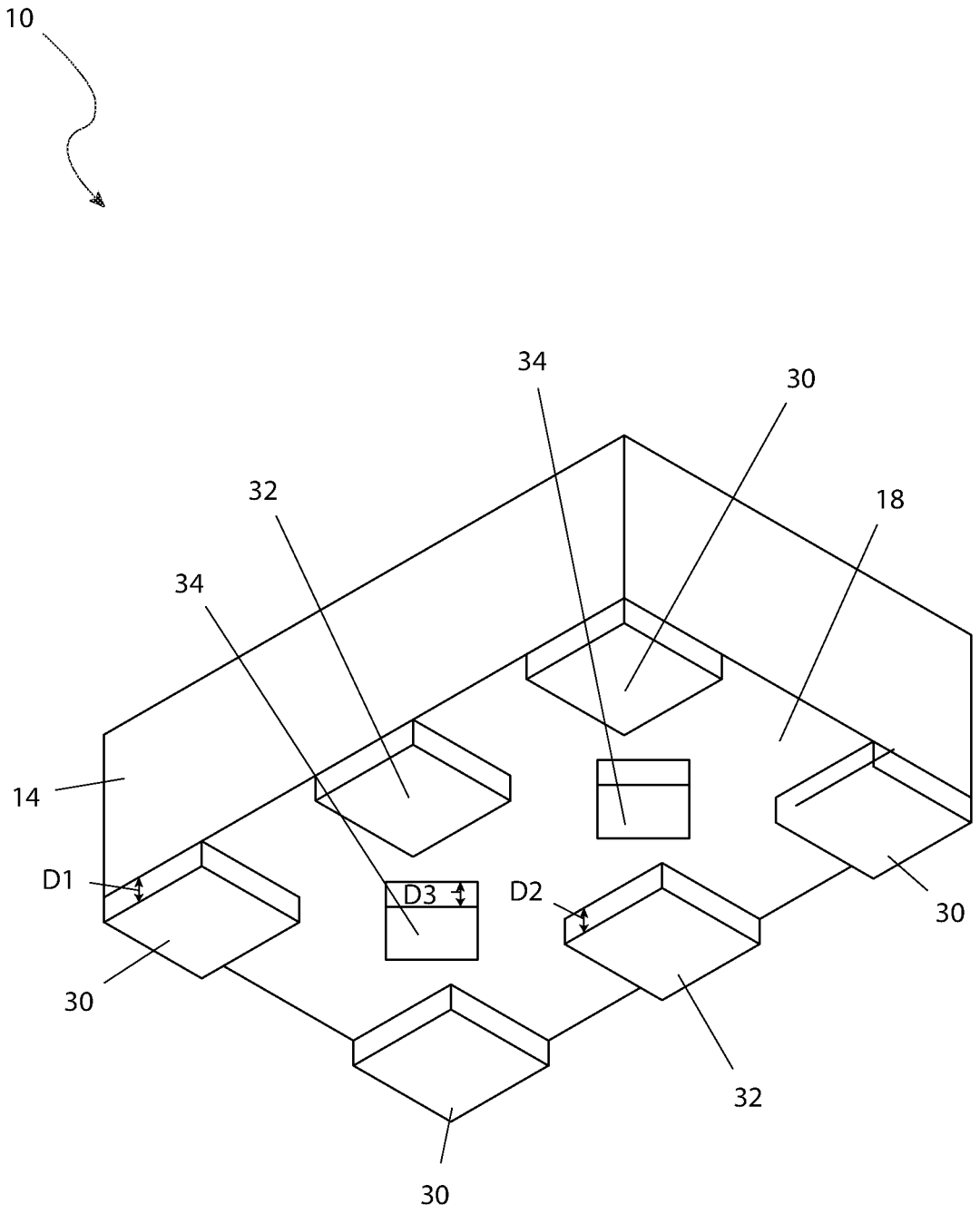
FIG. 6 is a bottom perspective view of the stacking device, according to the preferred embodiment of the present invention.

The corner posts 30 are disposed at each corner of base 12 and therefore there are four (4) corner posts 30 in the exemplary embodiment. In the exemplary embodiment, the corner posts 30 are oriented in such a way as to have no portion thereof protruding or extending away from the sidewalls of the base 12 and the outer surface 26 of the sidewalls 14. The corner posts 30 include a corner post first length L1 and a corner post second length L2. In some embodiments, the corner post first length L1 is approximately four and one-half inches (4.5 in.). In some embodiments, the corner post second length L2 is approximately four and one-half inches (4.5 in.). As shown in FIG. 6, the corner posts 30 include a corner post depth D1. In some embodiments, the corner post depth is approximately one inch (1.0 in.). In the exemplary embodiment, each corner post 30 is generally identical in size, shape, and orientation, although it is appreciated that other sizes and shapes can fall under the overfall scope of the invention.

The edge posts 32 are disposed equidistant between the corner posts 30 along both sides along sides of the base 12. In the exemplary embodiment, there are two (2) edge posts 32, although any number or orientation of such edge posts 32 as long as they are adjacent to the perimeter edges of the bottom surface 18 of the base 12. In the exemplary embodiment, the edge posts 32 are oriented parallel with the corner posts 30 such that no portion thereof protrudes or extends away from the sidewalls of the base 12 and the outer surface 26 of the sidewalls 14. Each edge post 32 includes an edge post first length L3 and an edge post second length L4. In some embodiments, the edge post first length L3 is approximately four and one-half inches (4.5 in.). In some embodiments, the edge post second length L4 is approximately four and one-half inches (4.5 in.). The edge posts 32 also include an edge post depth D2. In some embodiments, the edge post depth D2 is approximately one inch (1 in.). In the exemplary embodiment, each edge post 32 is generally identical in size, shape, and orientation, although it is appreciated that other sizes and shapes can fall under the overfall scope of the invention.

The center posts 34 are disposed along a bisecting center axis of the base 12 along parallel with the perimeter edges of the long side of base 12, and between the corner posts 30, and edge posts 32. In the exemplary embodiment, there are two (2) center posts 34, although more or less thereof, or even the absence thereof, are understood to fall under the overall scope of the present invention. The center posts 34 are each oriented at forty-five degree (45°) angles relative to the corner posts 30 and the edge posts 32. The center posts 34 include a center post first length L5 and a center post second length L6. In some embodiments, the center post first length L5 is approximately three inches (3.0 in.). In some embodiments, the center post second length L6 is approximately three inches (3.0 in.). The center posts 34 further include a center post depth D3. In some embodiments, the center post depth D3 is approximately one inch (1 in.). In the exemplary embodiment, each center post 34 is generally identical in size, shape, and orientation, although it is appreciated that other sizes and shapes can fall under the overfall scope of the invention.

In some embodiments, the stacking device 10 is made of a wax corrugated material suitable for food products both perishable and non-perishable. In some embodiments, the corner posts 30, edge posts 32, and center posts 34 are made from a corrugated material suitably study to withstand the forces due to repeated and rough handling and stacking.

2. Operation of the Preferred Embodiment

The preferred embodiment of the present invention can be utilized by the common user in a simple and effortless manner with little or no training. It is envisioned that the stacking device 10 would be constructed in general accordance with FIG. 1 through FIG. 7. The user would procure the stacking device 10 from conventional procurement channels.

After procurement, as shown in FIG. 7, the cavity 24 of a stacking device 10 is filled with products and placed on pallet P. Multiple stacking devices 10 can be stacked on top of each other and in conventional and/or proprietary stacking schemes for pallets P or other material handling. It is appreciated that the stacking devices 10 would have lids 40 installed or placed over the top to completely cover the cavity 24 and any products stored therein when in a particular and preferred method of use. The sizes, shapes, and orientation of the corner posts 30, edge posts 32, and center posts 34 facilitate stacking and allow for air flow to pass between the separate layers of stacking devices 10, and over and under any product stored therein, thereby providing a more even air distribution for cooling and/or freezing the food products contained in the stacking devices 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A stacking device comprising:

a base having an upper surface and a lower surface;

a plurality of sidewalls extending perpendicularly from edges of the base to define a cavity and form a five-sided structure;

a plurality of corner posts, each disposed at a respective corner of the base, each corner post having a first length and a second length, wherein the first length and the second length are equal, and a depth, wherein the depth is approximately one inch;

a plurality of edge posts disposed equidistant between the corner posts along a perimeter of the base, each edge post having a first length and a second length, wherein the first length and the second length are equal, and a depth, wherein the depth is approximately one inch; and, a plurality of center posts disposed along a bisecting center axis of the base, each center post having a first length and a second length, wherein the first length and the second length are equal, and a depth, wherein the depth is approximately one inch; wherein the corner posts, the edge posts, and the center posts are configured to facilitate the stacking of the stacking device onto at least one subjacent stacking device of similar or identical configuration, and to enhance air circulation around the stacked devices to facilitate flash freezing of products contained within the cavity.

2. The stacking device according to claim 1, wherein:

the base has an overall length of approximately nineteen inches, an overall width of approximately thirteen inches, and an overall depth of approximately six and one-half inches;

the corner posts are positioned at the respective corners of the base, each having the first length, the second length, and the depth;

the edge posts are positioned along the edges of the base between the corner posts, each having the first length, the second length, and the depth; and, the center posts are disposed along the bisecting center axis of the base between the corner posts and the edge posts, each having the first length, the second length, and the depth; and, wherein the corner posts, the edge posts, and the center posts are integrally formed with the base and are configured to align with corresponding posts of at least one subjacent stacking device when stacked, thereby providing structural stability and promoting airflow between the stacked devices to improve the efficiency of flash freezing of contents within the cavity.

* * * * *